United States Patent [19]

Hubbard et al.

[11] Patent Number: 4,606,341

[45] Date of Patent: Aug. 19, 1986

[54] NONCOLLAPSIBLE SURGICAL FACE MASK

[75] Inventors: Vance M. Hubbard; Welton K. Brunson, both of Bedford, Tex.

[73] Assignee: Tecnol, Inc., Fort Worth, Tex.

[21] Appl. No.: 778,880

[22] Filed: Sep. 23, 1985

[51] Int. Cl.[4] ..... A62B 7/00
[52] U.S. Cl. ..... 128/206.19
[58] Field of Search ..... 128/206.19

[56] References Cited

U.S. PATENT DOCUMENTS

| | | | |
|---|---|---|---|
| 3,613,678 | 10/1971 | Mayhew | 128/206.19 |
| 3,888,246 | 6/1975 | Lauer . | |
| 3,890,966 | 6/1975 | Aspelin et al. . | |
| 3,974,829 | 8/1976 | Tate, Jr. . | |
| 4,037,593 | 7/1977 | Tate, Jr. . | |
| 4,419,993 | 12/1983 | Petersen | 128/206.19 |

FOREIGN PATENT DOCUMENTS

| | | | |
|---|---|---|---|
| 2471792 | 6/1981 | France | 128/206.19 |
| 7706660 | 12/1977 | Netherlands | 128/206.19 |
| 4789 | of 1912 | United Kingdom | 128/206.19 |
| 967455 | 8/1964 | United Kingdom | 128/206.19 |
| 1588442 | 4/1981 | United Kingdom | 128/206.19 |

*Primary Examiner*—Henry J. Recla
*Attorney, Agent, or Firm*—Jerry W. Mills; Gregory M. Howison

[57] ABSTRACT

A noncollapsing pleated face mask (10) is disclosed. The face mask (10) is constructed entirely of heat seal bondable fabric. The mask (10) includes a trapezoidal-shaped single pleat (16) having reinforced side edges (30,32), and a reinforced folded longitudinal edge (28). The reinforcement along the diagonal side edges (30,32) and the longitudinal folded edge (28) is continuous so as to provide a pleated structure which resists deforming and collapsing against the wearer's face.

13 Claims, 4 Drawing Figures

NONCOLLAPSIBLE SURGICAL FACE MASK

TECHNICAL FIELD OF THE INVENTION

The present invention relates in general to medical apparel, and more particularly relates to single pleated surgical face masks.

BACKGROUND OF THE INVENTION

The demand for a particular type of surgical face mask depends, in a large part, on its utility and degree of comfort presented to the wearer. The utility of face masks is of significant importance to hospital personnel to prevent the spread of germs exhaled by the wearer. Prime importance is also placed on how comfortable a face mask is, as it is not uncommon for such medical apparel to be worn for hours at a time.

While a host of various types of surgical face masks are available, certain doctors and hospital personnel prefer the type in which the face panel includes a single pleat. With this type of surgical mask, the pleat is quite large and is adapted for billowing outwardly for comfortably and loosely covering the nose and mouth of the wearer. Tie strings are attached to the face panel for securing the mask to the head of the wearer. The mask must yet be collapsible into a compact layer for shipping and storing purposes.

One problem common to the single pleat type of face mask heretofore known is the repeated collapsing of the outwardly billowed face panel against the wearer's face during inhaling. Not only is this constant movement of the pleat annoying when worn for extended periods of time, but also exhaled moisture and perspiration from the wearer's face tend to collect on the mask. Moreover, the moisture which does collect on the face mask panel tends to diminish the stiffness of the pleat, and further exacerbates the problem.

The construction of a single pleat face mask requires creativity insofar as the mask must expand outwardly and around the face of a wearer, and also be foldable into a flat compact article. Resort has been had to a rounded edge pleat to facilitate conformance around the face. Such a face mask is disclosed in U.S. Pat. No. 4,419,993. With this construction, however, the pleat cannot be made by folding along the peripheral edge thereof, but must be constructed of two identical shaped pieces bonded together at the peripheral edge of the pleat.

From the foregoing, it may be seen that there is a need for a single pleat surgical face mask which conforms to the face of the wearer, is comfortable, and which resists collapsing during extended periods of use. There is an attendant need for a single pleat face mask which is easily manufactured.

SUMMARY OF THE INVENTION

In accordance with the present invention, a single pleat surgical face mask is provided which substantially reduces or eliminates the shortcomings previously associated with prior face masks.

The surgical face mask acording to the invention includes a rectangular-shaped face panel with tie strings connected at the corners thereof for securing the mask to a wearer's head. The face panel, as well as the tie strings, are constructed of a synthetic thermoplastic polymer which is both comfortable to wear, and which is economically heat seal bonded to provide all the bonding seams.

The single pleat of the face panel is made substantially seamless by folding a portion of the panel material together along a longitudinal edge. The pleat is trapezoidal-like in shape. the diagonal edges include a wide band of heat seal bonding therealong to provide rigidity to the pleat. The longitudinal folded edge also includes a heat seal bond therealong for reinforcing the pleat and guarding against collapsing when billowed outwardly around a wearer's face.

BRIEF DESCRIPTION OF THE DRAWINGS

For a detailed description of the present invention, and for further advantages and features thereof, reference is now made to the following description taken in conjunction with the accompanying drawings, in which.

DETAILED DESCRIPTION OF THE INVENTION

Figure 1:
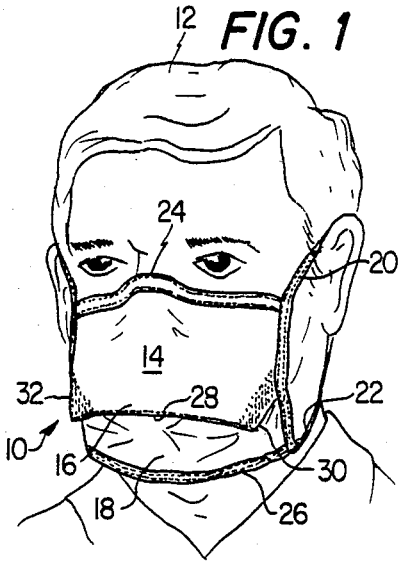
FIG. 1 is an isometric view of the single pleat face mask according to the invention, as worn by a person.

The principles and concepts of the invention are best understood by referring first to FIG. 1 of the drawing. The single pleat surgical face mask, generally designated 10, is shown worn over the nose and mouth of a person 12. The face mask 10 includes a panel 14 comprising a large pleat 16 and a bottom cover 18. The mask 10 is secured to the wearer 12 by a pair of upper tie strings and a pair of lower tie strings, one of each shown as 20 and 22 respectively. In actual practice, the upper tie string 20 and lower tie string 22 constitute a single strip of material fastened to the face mask edge. The continuity of the tie strings 20 and 22 adds strength thereto, and allows the mask to be pulled snugly against the face of the wearer 12.

The top edge 24 of the face panel 14 is conformable to the bridge of the wearer's nose so as to provide conformance of the mask to the wearer's face. The bottom edge 26 of the panel 14 is pulled against the lower part of the wearer's face by the lower tie strings, one shown as 22. The large single pleat 16, when expanded, billows outwardly in the area of the wearer's nose and mouth. In this manner, the mask 10 is not pulled tightly against the wearer's face to interfere with breathing or speaking. It can be appreciated that a mask which is pulled tightly, or flaps in and out against a person's nose and mouth becomes annoying and uncomfortable.

Further noted in FIG. 1, the single pleat 16 is deployed and billowed outwaredly when the top and bottom edges 24 and 26 of the face mask 10 are stretched slightly vertically upwardly around the nose and downwardly over the chin of the wearer. A folded longitudinal edge 28 of the single pleat 16 maintains the central part thereof disposed away from the wearer's face. Importantly, and to be discussed in greater detail below, the single pleat 16 is prevented from collapsing by being reinforced or stiffened along the diagonal side edges 30 and 32 thereof, and also along the folded longitudinal edge 28 thereof.

Figure 2:
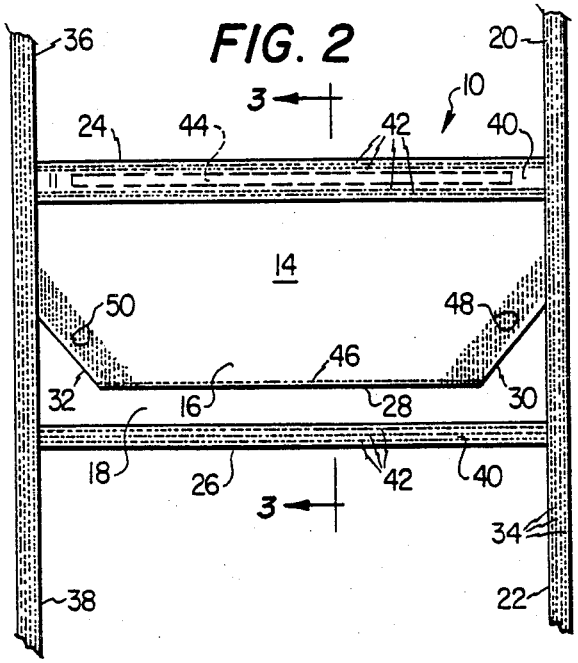
FIG. 2 is an elevational frontal view of the single pleat face mask with such pleat folded against the face panel thereof.

With reference to FIG. 2 the face panel 14 is shown with the single pleat 16 folded flatly against the bottom cover 18. As noted above, tie strings 20 and 22 comprise a unitary strip folded around the side edge of the face mask panel 14 and heat seal bonded 34 thereto, as well as along the entire length of the tie strings 20 and 22. Oppositely located tie strings 36 and 38 are comparably constructed and bonded to the opposing side edge of the face mask panel 14. The top edge 24 of the face panel 14, and the bottom edge 26 thereof include strips of border material 40 folded around such edges and heat seal bonded thereto, as shown by the dashed lines 42.

The single pleat 16 and the panel bottom cover 18 are constructed of a synthetic nonwoven polymer which is air permeable, and which is not characterized by loosely packed fibers. The tie strings 20, 22, 36 and 38 are also formed of a synthetic material. Hence, the various parts of the face mask 10 can be quickly and easily made integral by heat seal bonding techniques known in the art.

Shown in phantom in FIG. 2 is malleable stay 44 which, when pressed around the bridge of the wearer's nose, retains such shape and thereby provides full conformance of the mask top edge 24 to the wearer's face. The stay 44 can be constructed of conventional aluminum, or other suitable material.

According to a principal feature of the invention, the single pleat 16 is formed with a fold which forms the longitudinal edge 28. It is realized that a fold itself adds to the strength of the structure. Furthermore, spaced inwardly a short distance from the folded edged 28 is a stiffening agent 46 therealong. This combination provides a high degree of rigidity and prevents a wrinkle or crease from forming in the pleat 16 and collapsing inwardly onto the wearer's nose and mouth. This feature of the invention becomes highly important during long periods of wearing by keeping the single pleat 16 billowed outwardly, even though the face panel 14 may become wet due to perspiration or exhaled moisture.

The diagonal sides 30 and 32 of the single pleat 16 also include stiffening agents 48 and 50 for adding rigidity to the single pleat 16. The stiffening agent 46 along the longitudinal folded edge 28 is continuous with stiffening agents 48 and 50 of corresponding diagonal edges 30 and 32. For further structural reinforcement, the pleat 16 is formed trapezoidal in shape. With this composite construction, the single pleat 16 maintains its rigidity when billowed outwardly.

The stiffening or reinforcing agents 46, 48 and 50 may take various forms. In the preferred embodiment of the invention, the reinforcement of the single pleat 16 is characterized as a heat seal bond through the top part of the pleat 16 to the bottom part thereof along the peripheral edges 28, 30 and 32. With this technique, no additional material or weight is added to the face mask 10. In addition, the reinforcing process can be accomplished together with the bonding of the other parts of the mask 10. The reinforcement 48 and 50 along the diagonal edges 30 and 32 are shown as a plurality of dashed lines. The reinforcement 46 along the folded longitudinal edge 28 is less dense, and is thus shown as a single dashed line. In actual practice, it has been found that a single line of heat seal bondings, together with the folded longitudinal edge 28, provides adequate reinforcement against collapsing of such pleat.

The construction of the single pleat 16 is facilitated by simply folding material to form the trapezoidal-shaped pleat, and heat seal bonding the edges 28, 30 and 32. The entire panel 14 is a single piece of material, thus facilitating the assembly and construction of the mask 10. Plural pieces of fabric are not necessary, as is the case with the mask disclosed in the noted patent.

Figure 3:
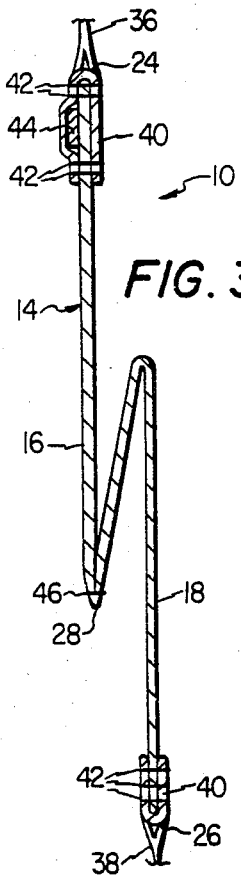
FIG. 3 is a cross-sectional view of the face mask of FIG. 2, taken along line 3—3 thereof.

FIG. 3 is a cross-sectional view of the flatly folded surgical face mask 10 illustrated in FIG. 2. The top edge 24 of the face panel 14 is shown constructed with a fabric border strip 40 folded around the top portion of the single pleat 16, as well as around the malleable stay 44. The top edge 24 is then heat seal bonded at 42. The stay 44 is thus sandwiched and confined therebetween. The bottom edge 26 of the panel 14 similarly includes a fabric border strip 40 folded therearound and heat seal bonded thereto at 42. The folded longitudinal edge 28 is reinforced by heat seal bond 46.

Figure 4:
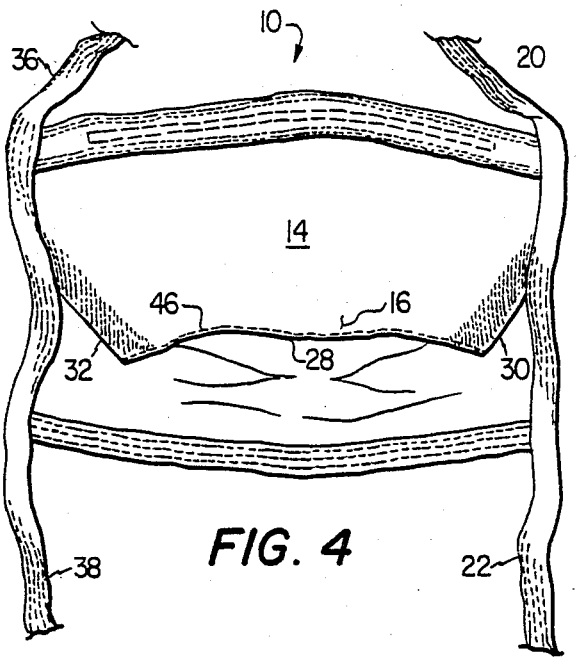
FIG. 4 is an elevational frontal view of the face mask, showing the single pleat thereof billowed outwardly.

The surgical mask 10 of FIG. 4 is shown with the single pleat 16 billowed outwardly, as it would appear when worn by medical personnel. It is seen that the reinforcement 46 along the folded longitudinal edge 28 improves the elastic limit of such edge, thus allowing the edge to withstand significantly higher forces before deforming and collapsing.

From the foregoing, a noncollapsing single pleat surgical face mask has been disclosed. The face mask is characterized by a single pleat with reinforcment along the entire peripheral edge thereof. When deployed or billowed outwardly, the reinforced single pleat resists deformation and collapsing against the wearer's face. The peripherl pleat edge reinforcement is characterized in the nature of plural heat seal bonds along the diagonal side edges of the pleat, and the fold with a single line of heat seal bonding on the longitudinal edge.

Since various modifications to the surgical face mask described herein are undoubtedly possible by those skilled in the art without departing from the scope and spirit of the invention, the detailed description is to be considered illustrative and not restrictive of the invention as claimed hereinbelow.

What is claimed is:

1. A method of fabricating a surgical face mask including a face panel having an upper edge, a lower edge, opposite side edges, an outer surface, an inner surface, an upper section, a central section and a lower section to prevent collapsing thereof when worn, comprising the steps of:

forming a pleat on the outer surface of the face panel by overlapping the central section of the face panel by folding it in opposite directions along two parallel longitudinal lines substantially transverse to the side edges of the panel such that the upper section extends above the uppermost parallel line and the lower section extends below the lowermost parallel line and said pleat defines a longitudinal overlapping folded edge along the lowermost longitudinal line;

forming nonfolded edges of the pleat on each side of the folded edge and diagonal to the side edges of the panel;

bonding the diagonal nonfolded edges together;

reinforcing the pleat along the folded longitudinal edge; and fixing a plurality of fastening strings to said face panel for fastening said panel to the face of a person.

2. The method of claim 1 wherein the reinforcing of said pleat comprises bonding the folded pleat along the longitudinal overlapping edge thereof.

3. The method of claim 2 wherein said bonding along said longitudinal overlapping edge is formed by heat seal bonding.

4. The method of claim 3 further including running a single heat seal bond along the [folded] longitudinal overlapping edge of the pleat.

5. The method of claim 1 wherein said bonding of said nonfolded edges of the pleat is caused by heat seal bonding.

6. The method of claim 5 wherein the bonding of the [side] nonfolded edges of the pleat and the reinforcing of the longitudinal overlapping edge of the pleat is formed as a continuous bond.

7. The method of claim 1 further including forming the pleat in a trapezoidal-like shape.

8. A surgical face mask for preventing the collapse thereof when worn, comprising:

a face panel for covering the face of a person, said face panel having an upper edge, a lower edge, opposite side edges, an outer surface, an inner surface, an upper section, a central section and a lower section;

a plurality of fastening strings fixed to said face panel for fastening said panel to the face of the person;

a pleat on the outer surface of said face panel formed by overlapping the central section of the face panel by folding it in opposite directions along two parallell longitudinal lines substantially transverse to the side edges of the panel such that the upper section extends above the pleat and the lower section extends below the pleat said pleat having opposite nonfolded edges disposed on each side of the folded edge, each said nonfolded edge being diagonal to the side edges of the face panel;

means for fixing said nonfolded diagonal edges together; and a reinforcement along the longitudinal folded edge of said pleat.

9. The improved face mask of claim 8 wherein said reinforcement comprises bonding the pleat along the longitudinal overlapping edge thereof.

10. The improved face mask of claim 9 wherein said bonding comprises a heat seal bonding.

11. The improved face mask of claim 10 wherein said bonding comprises a single heat seal bonding along the longitudinal overlapping edge of the pleat.

12. The improved face mask of claim 11 wherein said nonfolded edges are reinforced.

13. The improved face mask of claim 12 wherein said pleat is trapezoidal-like in shape, and wherein said reinforcement along the nonfolded edges and the longitudinal overlapping edge of said pleat includes a continuous heat seal bonding reinforcement.

* * * * *